United States Patent [19]

Rainville

[11] Patent Number: 4,917,651

[45] Date of Patent: Apr. 17, 1990

[54] FRONT OPENING BRASSIERE FOR EASY ACCESS AND REMOVAL BY A HANDICAPPED PERSON

[76] Inventor: Francine J. Rainville, 303 Fleet Dr., Beaconsfield, Quebec, Canada, H9W 5X8

[21] Appl. No.: 240,207

[22] Filed: Sep. 6, 1988

[51] Int. Cl.[4] ..... A41C 3/02

[52] U.S. Cl. ..... 450/58; 450/36; 2/101; 2/271

[58] Field of Search ..... 450/122, 58, 36, 33, 450/18, 17, 31, 70, 71; 2/101, 217, 271

[56] References Cited

U.S. PATENT DOCUMENTS

| | | | |
|---|---|---|---|
| 1,272,427 | 7/1918 | Haderlein | 450/58 X |
| 1,672,770 | 6/1928 | Mountain | 2/101 |
| 2,117,103 | 5/1938 | Rabensdorf | 450/17 X |
| 2,760,199 | 8/1956 | Champagne | 450/58 X |
| 2,882,905 | 4/1959 | Barg | 450/58 |
| 3,066,676 | 12/1962 | Kaupp | 450/58 |
| 3,173,420 | 3/1965 | Mazzoni et al. | 450/58 X |
| 3,968,803 | 7/1976 | Hyman | 450/58 |
| 4,072,255 | 2/1978 | Bogorad . | |
| 4,289,137 | 9/1981 | Dell et al. | 2/67 X |
| 4,325,378 | 4/1982 | Wilkinson | 450/58 X |

FOREIGN PATENT DOCUMENTS

| | | | |
|---|---|---|---|
| 200041 | 9/1938 | Switzerland | 450/36 |
| 839586 | 6/1929 | United Kingdom | 450/36 |

*Primary Examiner*—Werner H. Schroeder
*Assistant Examiner*—Jeanette E. Chapman

[57] ABSTRACT

A brassiere for handicapped people provides detachable and adjustable fabric fastening pads to temporarily hold the two halves together, and finger loops fopr those who cannot grip. The brassiere has a front opening with an overlapping portion joined to one brassiere cup which overlaps an underlapping portion joined to the other cup. Detachable and adjustable fabric fastening pads are provided on the underside of the overlapping portion to engage with support pads on the top surface of the underlapping portion. Fabric loops for fingers are provided attached to the overlapping and underlapping portions to avoid a person having to grip the edges of the two portions.

5 Claims, 2 Drawing Sheets

FRONT OPENING BRASSIERE FOR EASY ACCESS AND REMOVAL BY A HANDICAPPED PERSON

The present invention relates to a brassiere suitable for the handicapped. More specifically, the present invention provides a front opening brassiere which may be accessed and removed by handicapped people, particularly those with arthritis.

Handicapped people, particularly those with arthritis, often have difficulties in accessing and removing garments, because of the difficulty in attaching and detatching hooks and eyes, zippers, buttons and the like. For most people, dressing and undressing is an everyday occurrence that requires little time and thought. However, those people who are disabled and somewhat uncoordinated, who have diseases that affect the nervous system, or those people having inflammation of the joints, particularly those having arthritis, find the task of dressing and undressing both time consuming and difficult, some require assistance, but many disabled people must fend for themselves. Regular brassieres are hooked at the back, which can be difficult to attach and detach for those people who lack coordination or cannot grip a strap. Other types of brassieres are hooked at the front, but generally have a series of small hooks and eyes which require good hand coordination to join together. Neither type of brassiere can easily be joined by those people who cannot grip.

The present invention provides a brassiere which has a front opening with an overlapping portion joined to one brassiere cup which overlaps an underlapping portion joined to the other cup. Adjustable fabric fastening pads are on the underside of the overlapping portion to engage with support pads on the top surface of the underlapping portion of the brassiere cup or the portion of the brassiere cup itself. Fabric loops are also provided to avoid having to grip the edges of the overlapping and underlapping portions. An individual can put her fingers through the loops and pull the two portions together. A positive attachment means such as a large hook and eye is then provided which can be engaged while holding the portions with the loops and without having to grip and hold the overlapping and underlapping portions in the correct alignment because they are already held in place by the fastening pads. Thus a wearer uses the fastening pads to hold the overlapping and underlapping portions together, and makes the positive attachment, such as a large hook and eye by pulling the two halves of the brassiere with the finger loops.

The present invention provides a front opening brassiere for easy access and removal by a handicapped person, said brassiere comprising: brassiere cups having at least one joining piece extending around the back of a wearer; one brassiere cup having a center underlapping portion, the other cup having a center overlapping portion which extends over the underlapping portion between the brassiere cups; adjustable top and bottom fabric fastening pads, said pads being disposed in a spaced apart relationship on the underside of the overlapping portion to engage with corresponding support pads located on the top side of the brassiere cup with the underlapping portion; positive attachment means between the underside of the overlapping portion and a top side of the underlapping portion, said positive attachment means being located between said top and bottom fabric fastening pads; at least one fabric loop extending from the edge of the overlapping portion to assist in gripping the overlapping portion of the brassiere cup for access or removal; whereby said top and bottom fabric fastening pads and corresponding support pads, in conjunction with said fabric loop, are adapted to position said overlapping portion with respect to said underlapping portion to thereby facilitate the engagement and disengagement of said positive attachment means.

In drawings which illustrate embodiments of the present invention:

Figure 1:
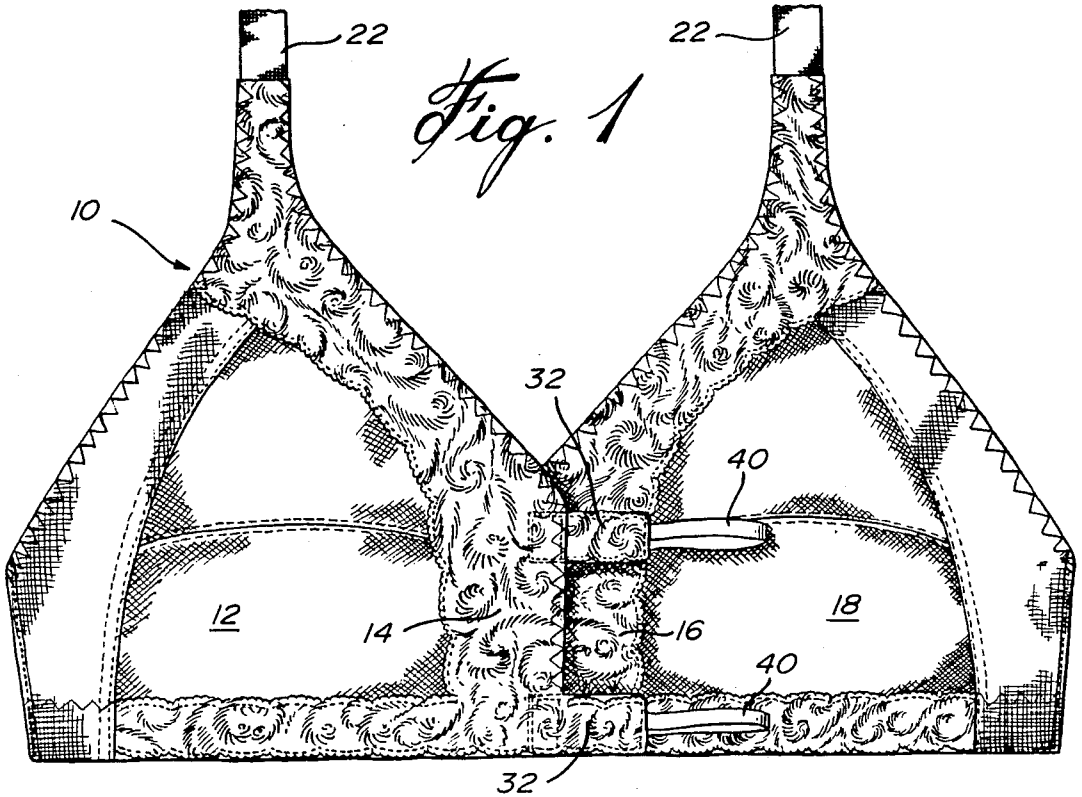
FIG. 1 is a front view of a front opening brassiere according to one embodiment of the present invention.
Figure 2:
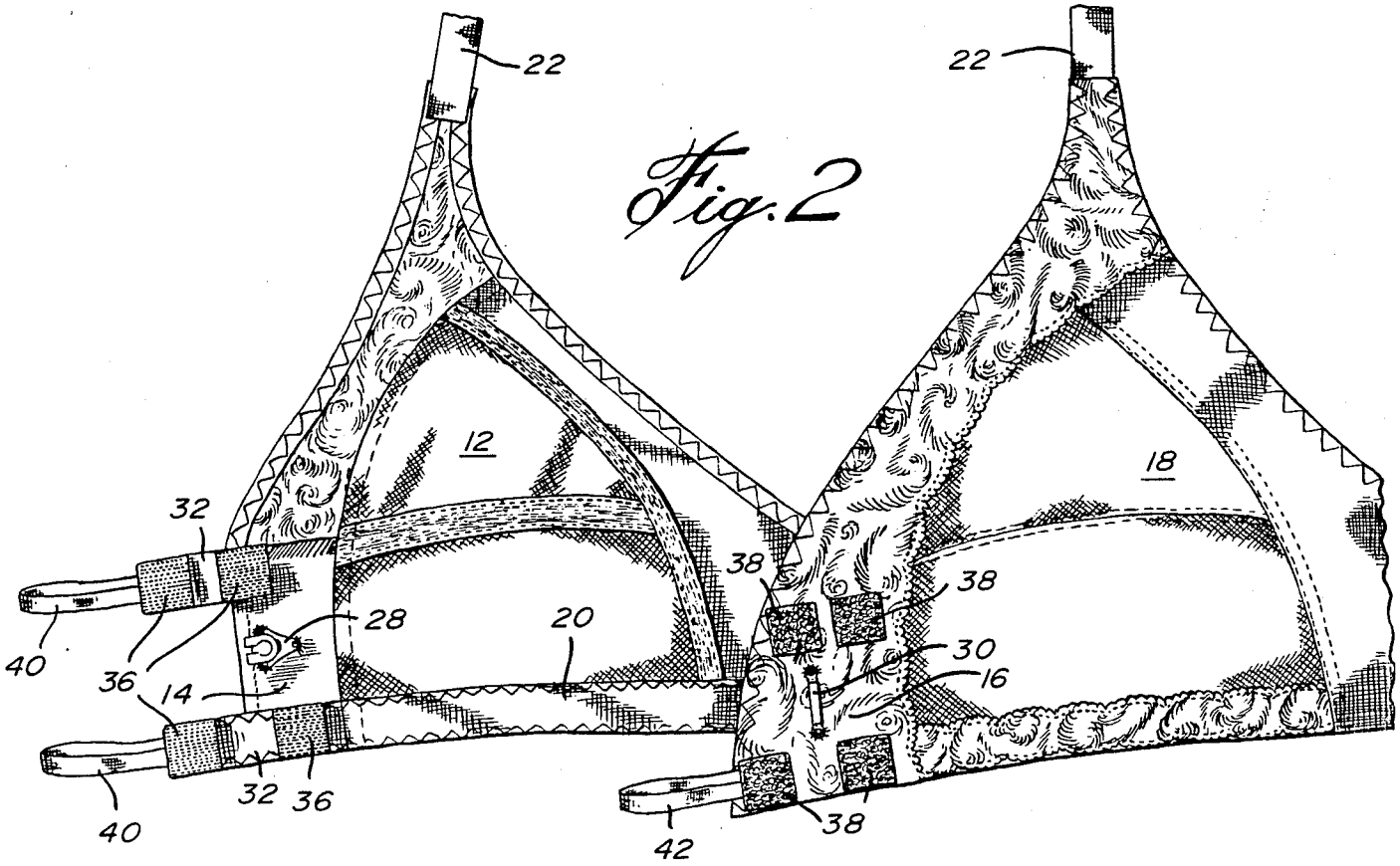
FIG. 2 is a schematic side view of the brassiere shown in FIG. 1 in the open form.

Referring now to the drawings, the front of the brassiere 10 is shown in FIG. 1 with one brassiere cup 12 having an overlapping portion 14 at its center overlapping an underlapping portion 16 of a second brassiere cup 18. A strap or back piece 20 as shown in FIG. 2 extends around the back of a wearer and shoulder straps 22 are provided from the top of the two brassiere cups 12 and 18 extending over the shoulders with adjustable straps (not shown) to connect with the back piece 20. Whereas the brassiere is shown in the drawings, to have shoulder straps, it will be apparent to those skilled in the art that different designs of brassiere, some with straps and some being of the under wire support type that do not have straps may also be made with the front opening design of the present invention.

As may be seen more clearly in FIG. 2, the overlapping portion 14 has on the underside, at the approximate center of the edge, a large hook 28 which is designed to fit into an eye 30 attached to the top side of the underlapping portion 16. The hook 28 and eye 30 are larger than those normally used with brassieres and other garments, so they may be easily joined together by those persons with coordination problems. In effect, the design is similar to those used on the waistband of trousers, pants and the like.

On each side of the hook 28, on the overlapping portion 14, are fabric strips 32 extending from the top and bottom edge of the overlapping portion 14 with square adjustable fabric fastening pads 36 attached on the underside of the strips. Whereas these pads 36 are shown as being square, they may be round, oval, or substantially any shape, but are preferably not long strips as it is found that handicapped people do not have the strength to separate a long fabric fastening strip. Whereas two pads are shown on each fabric strip 32, it would be apparent to those skilled in the art that more than two pads 36 may be provided. For a large size brassiere, it is preferred to have more hooks 28 and eyes 30 to provide a stronger connection, however, more fastening pads are not required as they do not hold the halves together permanently.

Support pads 38 are provided on the top surface of the underlapping portion 16 to mate with the fastening pads 36 on the fabric strips 32. In a preferred embodiment, the fastening pads 36 and support pads 32 are formed of Velcro, the trade mark for a fastening system wherein one pad has nylon hooks, and the support pad or other pad has a series of loops into which the hooks engage. For the purpose of the present application, the fastening pads 36 include the pads with the nylon hooks therein and the support pads 38 include the pads with the loops. Alternatively, these pads may be reversed with the support pads 38 having the nylon hooks.

Fabric loops 40, which may be made of ribbon material, are attached to the ends of the fabric strips 32. These loops 40 can be used by inserting a finger through a loop for those who cannot grip. A further fabric loop 42 is provided at the loWer edge of the underlapping portion 16 so that when a wearer first closes the brassiere, she has the finger or fingers of one hand through the loop 40 of the bottom fabric strip 32, the finger or fingers of the other hand through the loop 42 attached to the lower edge of the underlapping portion 16. She then pulls the edges together and allows the fastening pads 36 to engage and hold to the support pads 38. When this has been done, and still with fingers through the loop 40 of the top strip 32, she pulls the overlapping portion 14 across her body so the fastening pads 36 on the top strip are engaged with the support pads 38 on the underlapping portion. In the case where a person does not have the strength to pull, she may put a finger or thumb through a loop and then push the two portions together. The brassiere is now partially closed and it is merely necessary for the wearer to make the loops to engage the hook 28 on the underside of the overlapping portion 14 with the eye 30 on the top side of the underlapping portion 16. This can be achieved without having to put a strain on the joining halves of the brassiere as the overlapping portion 14 and the underlapping portion are already temporarily held together by the fastening pads 36 and the support pads 38.

The hook 28 and eye 30 are fairly large to allow the wearer to easily mate them together. They are kept in place by the fastening pads 36 engaging with the support pads 38. Thus even if there is little or no tension on the hook 28 and eye 30, they do not separate.

Because the fastening pads 36 and the support pads 38 are detatchable and adjustable, it is simple to detach them and move them from one position to another so that the fabric straps 32 lie flat on the underlapping portion. Whereas a hook 28 and eye 30 are shown herein, other types of positive attachment means may be provided, such as two or more smaller hook and eyes or a button arrangement. It is preferred, however, that the center attachment is a more positive attachment than the fastening pads 36 and support pads 38.

Various changes may be made to the embodiments described herein, for instance, a jabot or front flap with Velcro or other attachment means may be provided to cover the joint between the overlapping portion 14 and the underlapping portion 16, the present invention being limited only by the following claims.

The embodiments of the invention in which an exclusive property or privilege is claimed are defined as follows:

1. A front opening brassiere for easy access and removal by a handicapped person, said brassiere comprising:

brassiere cups having at least one joining piece extending around the back of a wearer;

one brassiere cup having a center underlapping portion, the other cup having a center overlapping portion which extends over the underlapping portion between the brassiere cups;

adjustable top and bottom fabric fastening pads, said pads being disposed in a spaced apart relationship on the underside of the overlapping portion to engage with corresponding support pads located on the top side of the brassiere cup with the underlying portion;

positive attachment means between the underside of the overlapping portion and a top side of the underlapping portion, said positive attachment means being located between said top and bottom fabric fastening pads;

at least one fabric loop extending from the edge of the overlapping portion to assist in gripping the overlapping poriton of the brassiere cup for access or removal;

whereby said top and bottom fabric fastening pads and corresponding support pads, in conjunction with said fabric loop, are adapted to position said overlapping portion with respect to said underlapping portion to thereby facilitate the engagement and disengagement of said positive attachment means.

2. The brassiere according to claim 1, wherein said top and bottom fabric fastening pads are disposed on the underside of corresponding top and bottom fabric strips extending from the edge of the said overlapping portion.

3. The brassiere according to claim 2 wherein the positive attachment means comprises at least one hook on the underside of the overlapping portion and at least one matching eye of the top side of the underlapping portion.

4. The brassiere according to claim 2 wherein a fabric loop for gripping is attached to the lower edge of the underlapping portion.

5. The brassiere according to claim 2 wherein the detachable and adjustable fabric fastening pads, and the support pads are formed of Velcro.

* * * * *